US009161567B2

(12) United States Patent
Shikata et al.

(10) Patent No.: US 9,161,567 B2
(45) Date of Patent: Oct. 20, 2015

(54) PORTION TOBACCO PRODUCT

(75) Inventors: Hiroki Shikata, Tokyo (JP); Michinori Yokoi, Tokyo (JP); Yasunobu Inoue, Tokyo (JP); Yuta Yoshimura, Tokyo (JP); Atsuro Yamada, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 255 days.

(21) Appl. No.: 13/559,309

(22) Filed: Jul. 26, 2012

(65) Prior Publication Data

US 2012/0298124 A1 Nov. 29, 2012

Related U.S. Application Data

(63) Continuation of application No. PCT/JP2011/051414, filed on Jan. 26, 2011.

(30) Foreign Application Priority Data

Jan. 28, 2010 (JP) ..... 2010-017284

(51) Int. Cl.
*A24B 15/00* (2006.01)
*A24B 13/00* (2006.01)

(52) U.S. Cl.
CPC ..... *A24B 13/00* (2013.01)

(58) Field of Classification Search
None
See application file for complete search history.

(56) References Cited

U.S. PATENT DOCUMENTS

| | | | | |
|---|---|---|---|---|
| 5,077,104 | A | 12/1991 | Hunt et al. | |
| 6,162,516 | A | 12/2000 | Derr | |
| 2005/0061339 | A1 * | 3/2005 | Hansson et al. | 131/352 |
| 2007/0012328 | A1 | 1/2007 | Winterson et al. | |
| 2007/0062549 | A1 | 3/2007 | Holton, Jr. et al. | |
| 2009/0025740 | A1 * | 1/2009 | Chappell et al. | 131/352 |

FOREIGN PATENT DOCUMENTS

| | | | |
|---|---|---|---|
| JP | 61-103446 | A | 5/1986 |
| JP | 10-66842 | A | 3/1998 |
| JP | 2008-538911 | A | 11/2008 |
| JP | 2009-529342 | A | 8/2009 |
| WO | WO 2007/104573 | A2 | 9/2007 |
| WO | WO 2008/135459 | A1 | 11/2008 |

* cited by examiner

*Primary Examiner* — Richard Crispino
*Assistant Examiner* — Phu Nguyen
(74) *Attorney, Agent, or Firm* — Birch, Stewart, Kolasch & Birch, LLP

(57) ABSTRACT

A portion tobacco product includes a tobacco filler containing leaf tobacco or a leaf tobacco component, and a first pouch containing a wrapping material having a function of controlling the permeation of a compound contained in the tobacco filler, wherein the tobacco filler is included in the first pouch.

10 Claims, 3 Drawing Sheets

PORTION TOBACCO PRODUCT

CROSS REFERENCE TO RELATED APPLICATIONS

This application is a Continuation Application of PCT Application No. PCT/JP2011/051414, filed Jan. 26, 2011 and based upon and claiming the benefit of priority from prior Japanese Patent Application No. 2010-017284, filed Jan. 28, 2010, the entire contents of all of which are incorporated herein by reference.

BACKGROUND OF THE INVENTION

1. Field of the Invention

The present invention relates to a portion tobacco product in which a tobacco filler is included in a pouch comprising a wrapping material having a function of controlling the permeation of a compound contained in the tobacco filler.

2. Description of the Related Art

Smokeless tobacco products such as moist-snuff or snuffs have attracted attention in recent years. These include a portion tobacco product in which a tobacco filler containing leaf tobacco shreds is wrapped in a pouch composed of a nonwoven fabric of cellulose fibers or the like. One can enjoy the taste and flavor derived from the leaf tobacco shreds of such a portion tobacco by putting it into the gap between the lip and gum in the mouth (U.S. Patent Application Publication No. 2007/062549).

In enjoying the taste and flavor derived from the leaf tobacco shreds of such a portion tobacco product, a leaf tobacco shred component or a component added to the shreds is eluted from the pouch into the saliva without being controlled, and may adversely affect the taste and flavor. Furthermore, the product comprising a tobacco filler that is wrapped in a pouch composed of a nonwoven fabric or the like is shipped in a state that the tobacco filler has been adjusted to have a constant water content; however, a colorant compound is eluted from the leaf tobacco shreds over time, and a visually unpleasant blot such as a spot occurs on the surface of the pouch in some cases. Furthermore, when such a product is put into the mouth according to a general usage, the tobacco filler gets wet by the moisture in the mouth, and thus the colorant compound derived from the leaf tobacco shreds is eluted, thereby the gum and skin in the mouth are stained in some cases.

U.S. Pat. No. 6,162,516 describes an impermeable sheet for preventing snuff from direct contact with the skin in the mouth. However, this sheet cannot prevent the colorant compound contained in the leaf tobacco shreds from causing staining of the pouch, and the colorant compound may be eluted into the saliva in the mouth. In such a case, this sheet cannot prevent the contact of the colorant compound with the skin in the mouth.

U.S. Pat. No. 5,077,104 does not disclose a portion tobacco product, but describes a nicotine-sealed pouch comprising a nicotine barrier layer containing a nitrile rubber-modified acrylonitrile-methyl acrylate copolymer and a nicotine degradation agent barrier layer. This pouch controls the transfer of a component by a substance that has a property of adsorbing nicotine (for example, a nitrilated acrylonitrile vinyl). Therefore, even if leaf tobacco shreds are applied to the pouch of this literature, the elution of substances other than nicotine cannot be suppressed, although the maintenance and control of elution of nicotine are possible.

PRIOR ART DOCUMENT

Patent Document

Patent Document 1: U.S. Patent Application Publication No. 2007/062549

Patent Document 2: U.S. Pat. No. 6,162,516

Patent Document 3: U.S. Pat. No. 5,077,104

BRIEF SUMMARY OF THE INVENTION

Problem to be Solved by the Invention

The present invention aims at providing a portion tobacco product that can suppress the elution of an unnecessary compound contained in a tobacco filler from a wrapping material while allowing the permeation of a flavor component contained in the tobacco filler from the wrapping material during the use of the product, and also can suppress the penetration of the unnecessary compound contained in the tobacco filler through the wrapping material during the storage of the product.

Means for Solving the Problem

The present inventors have done intensive studies so as to solve the above-mentioned problem. As a result, the inventors have obtained a portion tobacco product by which only tobacco flavor components can be tasted, by controlling the permeation of the compounds contained in the tobacco filler, specifically by suppressing the elution of an unnecessary high molecular compound (for example, a colorant compound) and suppressing the occurrence of spot during use and storage.

Specifically, according to the first aspect of the present invention, there is provided a portion tobacco product comprising a tobacco filler containing leaf tobacco or a leaf tobacco component, and a first pouch containing a wrapping material having a function of controlling the permeation of a compound contained in the tobacco filler, wherein the tobacco filler is included in the first pouch.

Effects of the Invention

According to the present invention, a portion tobacco product can be obtained which can suppress the elution of an unnecessary compound contained in the tobacco filler from the wrapping material while allowing the permeation of a flavor component contained in the tobacco filler from the wrapping material during the use of the product, and also can suppress the penetration of the unnecessary compound contained in the tobacco filler through the wrapping material during the storage of the product.

DETAILED DESCRIPTION OF THE INVENTION

Figure 1:
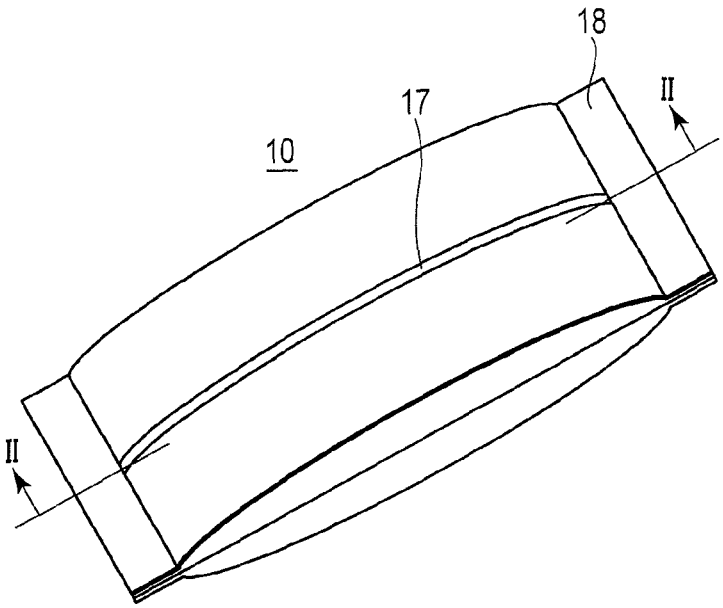
FIG. 1 is a schematic perspective view of the portion tobacco product according to the first embodiment of the present invention.

According to the first aspect of the present invention, there is provided a portion tobacco product comprising a tobacco filler containing leaf tobacco or a leaf tobacco component, and a first pouch containing a wrapping material having a function of controlling the permeation of a compound contained in the tobacco filler, wherein the tobacco filler is included in the first pouch.

In a preferable embodiment, the wrapping material has a property of allowing the permeation of a specific compound contained in the tobacco filler, and also has a property of suppressing the permeation of a different specific compound contained in the tobacco filler from the above specific compound. In a further preferable embodiment, the wrapping material has a hydrophilic property that is sufficient to allow the permeation of nicotine and also has a property of suppressing the permeation of a high molecular compound (for example, a colorant compound) contained in the tobacco filler, and has a cutoff molecular weight of 350 or more. More specifically, when the wrapping material is hydrophilic, it may have a cutoff molecular weight of 350 to 15,000. When the wrapping material is hydrophobic, the wrapping material may be obtained by subjecting a hydrophobic wrapping material having a cutoff molecular weight of 350 to 500,000 to a treatment with an amphipathic substance to impart a hydrophilic property that is sufficient for allowing the permeation of nicotine to the hydrophobic wrapping material.

A typical embodiment of the tobacco product of the present invention comprises, but is not limited to, a) to e) shown below.

a) A portion tobacco product comprising a tobacco filler that is wrapped in a first pouch containing a wrapping material having a molecular cutoff ability.

b) A portion tobacco product in which the portion tobacco product of a) is further wrapped in a second pouch containing a nonwoven fabric.

c) A portion tobacco product comprising a tobacco filler that is wrapped in a second pouch, wherein the second pouch is further wrapped in a first pouch.

d) A portion tobacco product in which a flavor filler containing a flavoring agent is included in a space between the first pouch and second pouch in the portion tobacco product of b).

e) A portion tobacco product in which a flavor filler containing a flavoring agent is included in a space between the second pouch and first pouch in the portion tobacco product of c).

Hereinafter the respective elements that constitute the portion tobacco product of the present invention will be explained in detail.

[First Pouch]

The portion tobacco product of the present invention comprises a first pouch that includes a tobacco filler directly or indirectly. The first pouch comprises a wrapping material having a function of controlling the permeation of a compound contained in the tobacco filler, i.e., a wrapping material having permeation selectivity on a specific component.

Such wrapping material has a property of allowing the permeation of a specific compound contained in the tobacco filler, and also has a property of suppressing the permeation of another specific compound contained in the tobacco filler. Specifically, such wrapping material has a hydrophilic property that is sufficient to allow the permeation of nicotine and also has a property of suppressing the permeation of a colorant compound contained in the tobacco filler, and has a cutoff molecular weight of 350 or more.

As used herein, the "hydrophilic property that is sufficient to allow the permeation of nicotine" means that the nicotine elution ratio measured in the following Examples is equal to or more than a predetermined value that is set in advance, preferably that the nicotine elution ratio is more than 0.07, and more preferably that the nicotine elution ratio is 0.1 or more. Furthermore, the "property of suppressing the permeation of a colorant compound" means that the turbidity and chromaticity that are measured in the following Examples are equal to or less than predetermined values that are set in advance, respectively, preferably that the turbidity is 20 degrees or less (undiluted) and the chromaticity is 100 degrees or less (undiluted), and more preferably that the turbidity is 10 degrees or less (undiluted) and the chromaticity is 50 degrees or less (undiluted).

Such wrapping material is specifically a membrane having molecular cutoff ability, for example, a dialysis membrane or an ultrafiltration membrane. As used herein, dialysis generally refers to the transfer of solute molecules through a membrane. On the other hand, ultrafiltration refers to a method for separating fine colloid particles, which are difficult to be separated by filtration by a general filtration method, from a dispersion medium by filtration.

When such a membrane has a property that a low molecular solute is passed whereas a high molecular solute is not passed, the membrane is said to have a molecular cutoff ability. Dialysis and ultrafiltration are utilized in various fields as important means for separation of solutes, and nowadays, dialysis membranes and ultrafiltration membranes having a various molecular cutoff ability are commercially available.

On the other hand, leaf tobacco contains nicotine that is a representative active ingredient, as well as a colorant compound that may cause unpleasant staining. It is desirable that the colorant compound does not penetrate through the first pouch, since the colorant compound may stain the wrapping though it does not affect the flavor of the portion tobacco product. Nicotine has a molecular weight of 162, whereas the colorant compound is generally bound to a protein or other molecule and has a molecular weight of several tens of thousands or more.

As mentioned below, the tobacco filler in the present invention can contain an additive that imparts flavor to the leaf tobacco shreds or leaf tobacco component. Typical examples of such flavor additive include salt, monosaccharides such as glucose and xylitol, disaccharides such as sucrose and lactose, vanillin and the like. The molecular weights of the respective additives are salt (58), glucose (180), xylitol (152), sucrose (342), lactose (342) and vanillin (152). Generally, a substance that can be used as the flavor additive has a sufficiently smaller molecular weight than that of the colorant compound.

If the first pouch does not comprise the wrapping material having a function of controlling the permeation of a compound contained in the tobacco filler, the leaf tobacco component, flavor component and colorant compound are eluted from the tobacco shreds contained in the portion tobacco, and are further eluted out of the portion tobacco through the first pouch. Therefore, if the tobacco filler is wrapped in the first pouch comprising a membrane having a molecular cutoff ability where the membrane allows the permeation of nicotine and the flavor component but does not allow the permeation of the colorant compound, it becomes possible to taste nicotine and the flavor component without elution of the colorant compound out of the first pouch. In other words, as demonstrated in the Examples below, if the tobacco filler is wrapped in the above-mentioned first pouch, it becomes possible to taste only components that are useful as the tobacco flavor without occurrence of spot derived from the leaf tobacco during storage and without elution of the colorant compound out of the wrapping material during use.

In the case of a hydrophilic wrapping material, it is needless to say that a too large cutoff molecular weight is not preferable since it allows the permeation of both nicotine and colorant compound. If a hydrophilic wrapping material has too small cutoff molecular weight, there is a problem that the molecular weight of the component that passes through the membrane is limited, the velocity of the taste-contributing component to pass through the membrane is decreased, and thus the flavor is deteriorated.

On the other hand, in the case of the hydrophobic wrapping material, since the wrapping material does not allow the permeation of water, a hydrophilic substance cannot be permeated and thus the elution of the colorant compound can be suppressed, whereas there is a problem that the elution of the leaf tobacco component and flavor component is also suppressed. Therefore, the present inventors have tried to conduct a surface treatment of the hydrophobic wrapping material with an amphipathic substance, and found that the treated hydrophobic wrapping material allows the permeation of nicotine that is a leaf tobacco component but can suppress the permeation of the colorant compound, and thereby solved the above-mentioned problem. However, if the hydrophobic wrapping material has a too small cutoff molecular weight, it has a similar problem that the velocity of the taste-contributing component to pass through the membrane is too low, and thus the flavor is deteriorated. The hydrophobic wrapping material also has a problem that a surface treatment can be conducted up to only a certain size of cutoff molecular weight.

Therefore, in both cases of the hydrophilic and hydrophobic wrapping materials, it is desirable to select a membrane having a molecular cutoff ability where the membrane enables the suppression of the elution of the colorant compound and allows the permeation of useful nicotine and other flavoring agents.

When the wrapping material (specifically membrane) is hydrophilic, the specific cutoff molecular weight of the membrane is preferably from 350 to 100,000, more preferably from 350 to 15,000, further preferably from 500 to 15,000. When the wrapping material (specifically membrane) is hydrophobic, it is preferably a membrane that has been subjected to a treatment with an amphipathic substance such as a phospholipid, an oil and fat, or a fatty acid, thereby having been imparted a hydrophilic property that is sufficient for allowing the permeation of nicotine. The specific cutoff molecular weight of the hydrophobic membrane before such treatment is preferably from 350 to 1,000,000, more preferably from 350 to 500,000, further preferably from 500 to 500,000. In the case of the hydrophobic wrapping material, the cutoff molecular weight refers to a value obtained by measuring the wrapping material before the treatment with the amphipathic substance.

The hydrophobicity/hydrophilicity of the wrapping material can be evaluated by the permeation velocity of water that permeates through the wrapping material. 1 L of water is contacted with the wrapping material at a water pressure of 1 $kg/cm^2$, and the permeation amount of the water per a unit area and a unit time is measured. If the water does not permeate through under the above-mentioned conditions, the wrapping material is deemed to be hydrophobic, whereas if the water permeates, the wrapping material is deemed to be hydrophilic.

A hydrophilic wrapping material is preferable in that it can be used without being treated the surface thereof in advance, since the hydrophilic wrapping material does not prevent the permeation of both nicotine and the colorant compound due to the hydrophilic property. As for a hydrophobic wrapping material, if the hydrophobic wrapping material is used without being treated the surface thereof, it cannot permeate nicotine which is a representative ingredient of the leaf tobacco, and also cannot permeate the colorant compound. However, according to the finding of the present inventors, if the hydrophobic wrapping material is subjected to the surface treatment with an amphipathic substance such as a phospholipid, a fat and oil, or a fatty acid, the treatment can impart a property of allowing the permeation of nicotine through the hydrophobic wrapping material while maintaining a property of preventing the permeation of the colorant compound.

In the case where a dialysis membrane or ultrafiltration membrane is used as the hydrophilic wrapping material, the dialysis membrane or ultrafiltration membrane can be made from a material selected from the group consisting of cellulose, cellulose acetate, polycarbonate, polysulfone, polyethersulfone, polymethyl methacrylate, polymethacrylate, polymethyl acrylate, polyacrylate, polyamide, nylon, polyvinylidene fluoride, polyacrylonitrile, polyester, polyurethane, polystyrene, polyethylene and polypropylene. In the case where a dialysis membrane or ultrafiltration membrane is used as the hydrophobic wrapping material, the dialysis membrane or ultrafiltration membrane can be made from a material selected from the group consisting of polytetrafluoroethylene, polyvinylidene fluoride, polypropylene, polyethylene and polysulfone.

Examples of the hydrophilic wrapping material include Spectra/Pro (Spectrum Laboratories, Inc.) Biotech Cellulose Ester Membranes CE dialysis tube, Cellu-Sep T3 Tubular Membrane (Membrane Filtration Products, Inc.) and the like. Examples of the hydrophobic wrapping material include Spectra/Por (Spectrum Laboratories, Inc.) Biotech polyvinylidene difluoride Membranes PVDF dialysis tube and the like.

As the amphipathic substance for treating the hydrophobic wrapping material, a phospholipid, a fat and oil, a fatty acid or a combination thereof can specifically be used, and more specifically, a mixture of lecithin and oleic acid (weight ratio 1:99 to 10:90) can be used. The hydrophobic wrapping material can be treated by applying a solution containing the amphipathic substance to the hydrophobic wrapping material. For example, the hydrophobic wrapping material can be treated by applying 1 to 20 μl of a solution containing the amphipathic substance in a concentration of 1 to 10% by weight, per 1 $cm^2$ of the hydrophobic wrapping material. Alternatively, the hydrophobic wrapping material can be treated by soaking it into a solution containing the amphipathic substance in a concentration of 1 to 10% by weight for 5 to 180 minutes.

The first pouch can optionally contain an additive such as an emulsifier, an antioxidant or a preservative. The pouch containing such an additive can be obtained by applying an additive-dissolving solution to the pouch.

Examples of the emulsifier include thickening polysaccharides such as alginic acid or potassium, sodium, calcium and ammonium salts thereof, guar gum, gum arabic, xanthan gum, karaya gum, hydroxypropyl cellulose, hydroxypropyl starch, hydroxypropyl methyl cellulose and methyl cellulose; phosphoric acid and potassium, sodium and calcium salts thereof; trisodium citrate; synthetic triglycerides; plant sterols; gellatin; glycerol fatty acid esters; lecithins such as plant lecithin, hydroxylated lecithin and egg yolk lecithin; saponins; sucrose fatty acid esters of higher fatty acids such as stearic acid, palmitic acid and oleic acid and of lower fatty acids such as acetic acid and isobutyric acid; and the like.

Examples of the antioxidant or preservative include organic acids such as ascorbic acid, Vitamin E, acetic acid, citric acid, lactic acid, malic acid, sorbic acid and tartaric acid.

Examples of other additives include unsaturated fatty acids such as docosahexaenoic acid, linoleic acid, linolenic acid and oleic acid; saturated fatty acids such as palmitic acid and stearic acid; vegetable oils such as castor oil, shortening, salad oil, corn oil, sesame oil, rapeseed oil, sunflower oil, palm oil, coconut oil, olive oil, cacao butter and jojoba oil; animal oils such as lard, fish oil, butter, squalene, liver oil and beeswax, and mixtures thereof.

The portion tobacco product of the present invention may be produced by, for example, sealing a sheet-shaped pouch material in the longitudinal direction to form it into a tube-shape, charging the tube-shaped pouch material with the tobacco filler, and sealing the both ends of the pouch material. Although the method for sealing is not particularly limited, heat sealing is especially preferable in view of production efficiency. Therefore, in order to impart a heat seal property to the pouch material, polypropylene, polyethylene, polyurethane, polyolefin, rosin ester, a resin hot-melt adhesive, polyamide, polyester or other heat seal material may be applied to the heat seal parts of the sheet-shaped first pouch material (reference numbers 17 and 18 in FIG. 1), or may be applied to the whole surface of the one side or the whole surfaces of the both sides of the sheet-shaped first pouch material. Alternatively, the heat seal material may be incorporated into the raw material itself for the first pouch material during the preparation of the first pouch material. Furthermore, the first pouch may be modified by a physical or chemical treatment so as to improve the heat seal property. In addition, the pouch material can be obtained in the form of a tube from the beginning, and in such case, a pouch can be formed by sealing the both end parts.

[Tobacco Filler]

The tobacco filler contains tobacco shreds or tobacco powder obtained by cutting or grinding leaf tobacco, or a leaf tobacco component such as a leaf tobacco extract. The tobacco filler can contain the other tobacco material, a flavoring agent and/or a humectant in addition to the leaf tobacco or leaf tobacco component.

Examples of the kinds of the tobacco leaf include burley tobacco, flue-cured tobacco, oriental tobacco and the like.

Examples of the other tobacco material include the midrib of leaf tobacco, fermented tobacco, dark-cured tobacco, a reconstituted tobacco material and the like.

Examples of the flavoring agent include a powdered material derived from plants such as fruits and tea leaves, menthol, mint, amino acids (glycine etc.), plant extracts (eucalyptus, rosemary, GSE), flavonoids, Vitamin E, Vitamin C, citric acid, salt, monosaccharides such as fructose, disaccharides such as sucrose, oligosaccharides, other polysaccharides, spice-based spices such as cinnamon, horseradish (Japanese horseradish), red pepper, Japanese pepper, clove, ginger, turmeric, allspice and cardamom, herb-based spices such as basil, bay leaves, marjoram, oregano, rosemary, sage, tarragon, thyme, sesame, garlic and onion, seed-based spices such as caraway, anise seed, celery seed, coriander, cumin seed, dill seed, fennel, mace, nutmeg and poppy seed, chocolate, citrus fruit and other fruit flavors, vanillin, ethyl vanillin, bergamot oil, linalool, lemon oil and the like.

Examples of other additives include organic acids such as citric acid, gluconic acid and succinic acid, and sodium and potassium salts thereof, as pH adjusting agents. Furthermore, carbonates and hydrogencarbonates of sodium, potassium and calcium are also included. Sodium, potassium and calcium salts of phosphate and hydrogenphosphate are also included.

Examples of the humectant include polyhydric alcohols such as glycerin and propylene glycol, sugar alcohols such as erythritol, xylitol and sorbitol, hyaluronic acid, and the like.

The tobacco filler may contain water derived from the above-mentioned raw materials, and may further contain additional water. The water content of the tobacco filler is finally adjusted to 10 to 50% by weight, preferably 25 to 50% by weight of the tobacco filler.

[Second Pouch]

The second pouch in the present invention wraps the tobacco filler directly, or wraps the first pouch including the tobacco filler. The second pouch needs to be insoluble in water added during the manufacturing and in saliva during use without inhibiting the elution of the components from the tobacco filler. The second pouch also needs to have a strength when the second pouch holds moisture. Specifically, a porous water-insoluble base material is preferably used for the second pouch. Such base material can be made from water-insoluble fibers. Examples of the water-insoluble fibers include cellulose-based vegetable fibers derived from plants, polymer-based vegetable fibers such as corn starch, and nylon-based, polyvinyl alcohol-based, polyester-based, acrylic-based, polyolefin-based and polyurethane-based synthetic fibers. More specifically, the second pouch is a sheet or bag of a woven fabric or nonwoven fabric containing at least one kind of these fibers. A preferable base material for the second pouch is a nonwoven fabric that is constituted by cellulose fibers such as a material for tea bags. The base material for the second pouch is selected so as to have preferable properties such as the permeability of the tobacco filler components, porosity, insolubility and texture. A typical material for the second pouch is a material for tea bags having a basis-weight of 27 g/m$^2$, a whiteness degree of 65% and a wet tensile strength of 28 N/50 mm, or a nonwoven fabric SDH27 (manufactured by BFF).

Similarly to the first pouch, the above-mentioned heat seal material may be applied to the heat seal part of a sheet-shaped second pouch material, or may be applied to the whole surface of the one side or the whole surfaces of the both sides of the sheet-shaped second pouch material. Alternatively, the heat seal material may be incorporated into the raw material itself for the second pouch material during the preparation of the second pouch material. Furthermore, the second pouch may be modified by a physical or chemical treatment so as to improve the heat seal property.

[Flavor Filler]

The flavor filler in the present invention is included in a space between the first pouch and second pouch, and mainly aims at imparting flavor to the tobacco product. The flavor filler does not contain leaf tobacco or a leaf tobacco component. The flavor filler can contain a flavoring agent and a humectant, and the like.

Examples of the flavoring agent include a powdered material derived from plants such as fruits and tea leaves, menthol, mint, amino acids (glycine etc.), plant extracts (eucalyptus, rosemary, GSE), flavonoids, Vitamin E, Vitamin C, citric acid, salt, monosaccharides such as fructose, disaccharides such as sucrose, oligosaccharides, other polysaccharides and the like, spice-based spices such as cinnamon, horseradish (Japanese horseradish), red pepper, Japanese pepper, clove, ginger, turmeric, allspice and cardamom, herb-based spices such as basil, bay leaves, marjoram, oregano, rosemary, sage, tarragon, thyme, sesame, garlic and onion, seed-based spices such as caraway, anise seed, celery seed, coriander, cumin seed, dill seed, fennel, mace, nutmeg and poppy seed, chocolate, citrus fruit and other fruit flavors, vanillin, ethyl vanillin, bergamot oil, linalool, lemon oil and the like.

Examples of other additives include organic acids such as citric acid, gluconic acid and succinic acid, and sodium and potassium salts thereof, as pH adjusting agents. Furthermore, carbonates and hydrogencarbonates of sodium, potassium and calcium are also included. Sodium, potassium and calcium salts of phosphate and hydrogenphosphate are also included.

Examples of the humectant include polyhydric alcohols such as glycerin and propylene glycol, sugar alcohols such as erythritol, xylitol and sorbitol, hyaluronic acid, and the like.

[Method for Measurement of Cutoff Molecular Weight]

Hereinafter, a specific method for measuring the above-mentioned cutoff molecular weight will be explained.

A cutoff molecular weight is used as an index for the separation performance of a dialysis membrane or ultrafiltration membrane. In order to determine the cutoff molecular weight of a membrane, the blocking ratio against membrane permeation is measured with respect to each of several kinds of marker molecules having different molecular weights, such as the marker molecules shown in Table 1. The obtained blocking ratios are plotted against the molecular weights to obtain the cutoff curve. Based on this cutoff curve, the cutoff molecular weight of a membrane is defined as the molecular weight at which 90% of the blocking ratio is achieved. In the case where the membrane is hydrophilic, the cutoff molecular weight can be measured by applying the marker molecules shown in Table 1 to the membrane without pre-treating the membrane. In the case where the membrane is hydrophobic, it is necessary to conduct a pre-treatment by passing a solvent having a low surface tension such as ethanol or isopropyl alcohol through the membrane before measuring the cutoff molecular weight, and the cutoff molecular weight can be measured by applying the marker molecules shown in Table 1 to the thus-treated hydrophobic membrane. It is also possible to evaluate the cutoff molecular weight of the membrane by using marker molecules other than the marker molecules shown in Table 1.

The blocking ratio is obtained by the following formula from the concentration value of a solute at the side of a feeding liquid and the concentration value of the solute at the side of an eluate, where the membrane is put between the feeding liquid and the eluate.

$$\text{Blocking ratio}=1-[(\text{solute concentration in eluate})/(\text{solute concentration in feeding liquid})]$$

TABLE 1

Marker molecules for investigating separation properties of dialysis membrane and ultrafiltration membrane

| | Molecular weight [g/mol] | Molecular diameter (estimation) [nm] |
|---|---|---|
| Sucrose | 340 | 1.1 |
| Raffinose | 590 | 1.3 |
| Vitamin B12 | 1,360 | 1.7 |

TABLE 1-continued

Marker molecules for investigating separation properties of dialysis membrane and ultrafiltration membrane

| | Molecular weight [g/mol] | Molecular diameter (estimation) [nm] |
|---|---|---|
| Bacitracin | 1,410 | 1.7 |
| Insulin | 5,700 | 2.7 |
| Cytochrome C | 13,400 | 3.8 |
| Myoglobin | 17,000 | 4.0 |
| α-chymotrypsinogen | 25,000 | 4.6 |
| Pepsin | 35,000 | 5.0 |
| Ovalbumin | 43,000 | 5.6 |
| Bovine albumin | 67,000 | 6.4 |
| Aldolase | 142,000 | 8.2 |
| γ-globulin | 150,000 | 8.4 |

Illustration of Specific Embodiments

The specific embodiments of the present invention will be illustrated with referring to the drawings. Throughout all drawings, the same or similar elements are represented by the same reference numbers.

Figure 2:
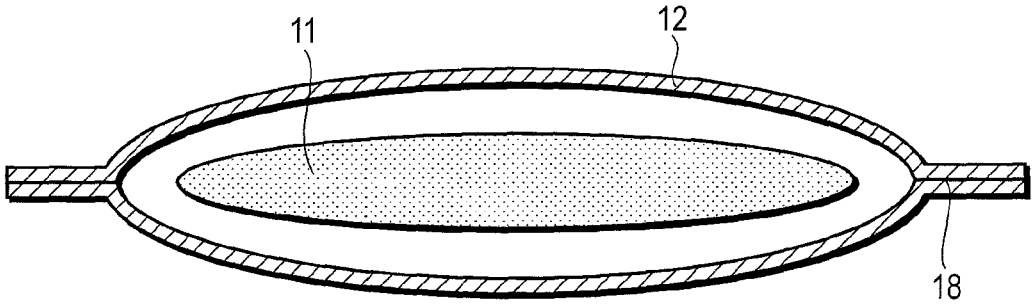
FIG. 2 is a cross-sectional view along the line II-II in FIG. 1.

FIG. 1 is a perspective view schematically showing the portion tobacco product according to the first embodiment of the present invention. FIG. 2 is a cross-sectional view along the line II-II in FIG. 1.

The portion tobacco product shown in FIG. 1 comprises first pouch 12 which (directly) includes tobacco filler 11. The first pouch can be produced by, for example, sealing a sheet-shaped first pouch material at heat seal part 17 in the longitudinal direction to form the material into a tube-shape, charging the tube-shaped first pouch material with the tobacco filler, and heat-sealing the both ends of the first pouch at heat seal parts 18 in the lateral direction. Alternatively, the portion tobacco product according to the first embodiment can be also produced by wrapping the tobacco filler in the sheet-shaped first pouch material, and then heat-sealing in the longitudinal direction and lateral direction (17 and 18).

Figure 3:
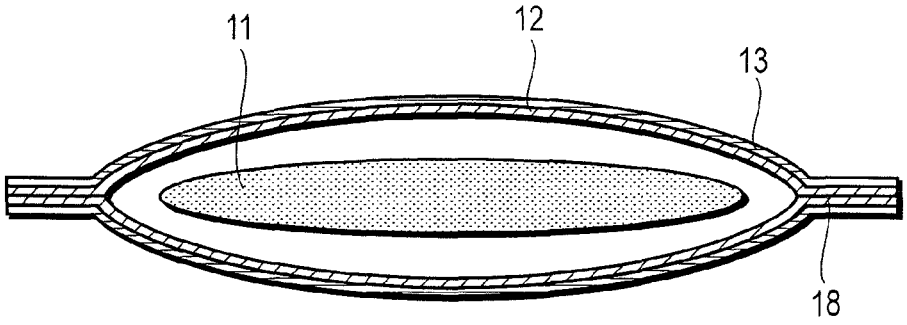
FIG. 3 is a cross-sectional view of the portion tobacco product according to the second embodiment of the present invention.

FIG. 3 is a cross-sectional view of the portion tobacco product according to the second embodiment of the present invention, which is similar to FIG. 2. The portion tobacco product according to the second embodiment comprises first pouch 12 which directly includes tobacco filler 11, and second pouch 13 which includes the first pouch 12. The portion tobacco product according to the second embodiment can be produced by, for example, charging a tube-shaped first pouch material with the tobacco filler, further wrapping the first pouch material in a sheet-shaped second pouch material, sealing the second pouch in the longitudinal direction to form the pouch into a tube-shape, and heat-sealing the both ends of the first pouch and the both ends of the second pouch together.

Figure 4:
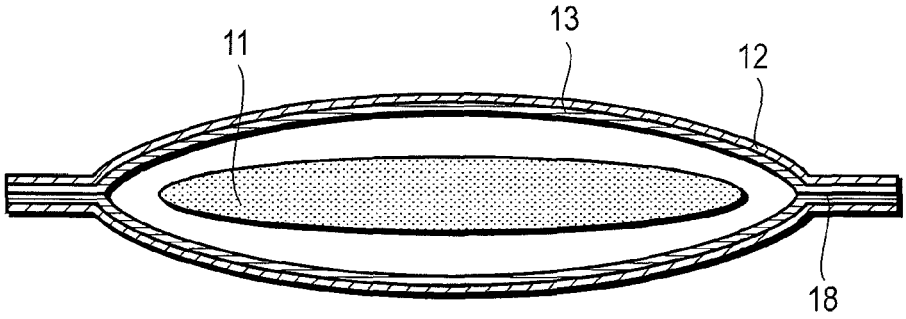
FIG. 4 is a cross-sectional view of the portion tobacco product according to the third embodiment of the present invention.

FIG. 4 is a cross-sectional view of the portion tobacco product according to the third embodiment of the present invention, which is similar to FIG. 2. The portion tobacco product according to the third embodiment comprises second pouch 13 which directly includes tobacco filler 11, and first pouch 12 which includes the second pouch 13. The portion tobacco product according to the third embodiment can be produced by, for example, charging a tube-shaped second pouch material with the tobacco filler, further wrapping the second pouch material in a sheet-shaped first pouch material, sealing the first pouch in the longitudinal direction to form the pouch into a tube-shape, and heat-sealing the both ends of the second pouch and the both ends of the first pouch together.

Figure 5:
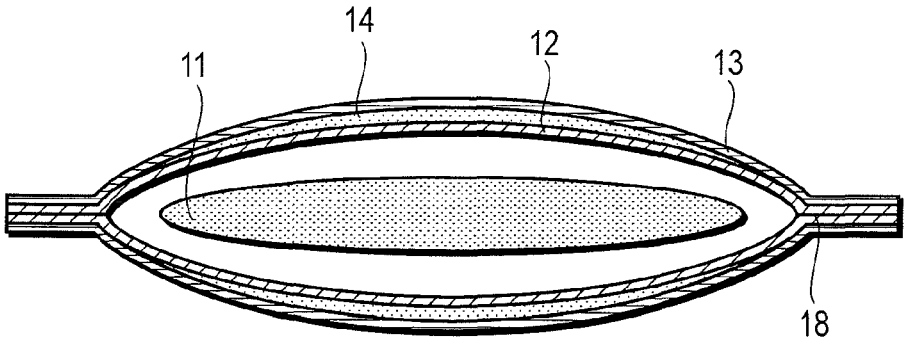
FIG. 5 is a cross-sectional view of the portion tobacco product according to the fourth embodiment of the present invention.

FIG. 5 is a cross-sectional view of the portion tobacco product according to the fourth embodiment of the present invention, which is similar to FIG. 2. The portion tobacco product according to the fourth embodiment comprises first pouch 12 which directly includes tobacco filler 11, and second pouch 13 which includes the first pouch 12, wherein flavor filler 14 is included in a space between the first pouch 12 and second pouch 13. The portion tobacco product according to the fourth embodiment can be produced by, for example, including the tobacco filler in a tube-shaped first pouch material, further wrapping the first pouch material in a sheet-shaped second pouch material, sealing the second pouch in the longitudinal direction to form the pouch into a tube-shape, including the flavor filler in a space between the first pouch material and second pouch material, and finally heat-sealing the both ends of the first pouch and the both ends of the second pouch together.

Figure 6:
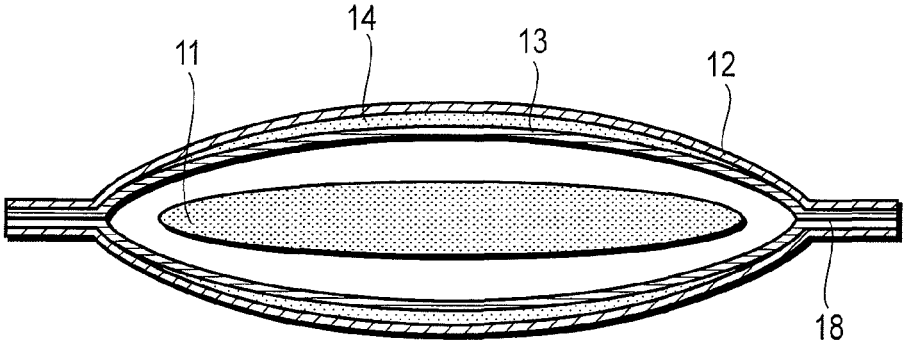
FIG. 6 is a cross-sectional view of the portion tobacco product according to the fifth embodiment of the present invention, in which a flavor filler containing a flavoring agent is included.

FIG. 6 is a cross-sectional view of the portion tobacco product of the fifth embodiment of the present invention, which is similar to FIG. 2. The portion tobacco product according to the fifth embodiment comprises second pouch 13 which directly includes tobacco filler 11, and first pouch 12 which includes the second pouch 13, wherein flavor filler 14 is included in a space between the first pouch 12 and second pouch 13. The portion tobacco product according to the fifth embodiment can be produced by, for example, including the tobacco filler in a tube-shaped second pouch material, further wrapping the second pouch material in a sheet-shaped first pouch material, sealing the first pouch in the longitudinal direction to form the pouch into a tube-shape, including the flavor filler in a space between the second pouch material and first pouch material, and finally heat-sealing the both ends of the second pouch and the both ends of the first pouch together.

In addition, all of the portion tobacco products according to the second to fifth embodiments can also be produced by superimposing a sheet-shaped first pouch material and a sheet-shaped second pouch material, wrapping the tobacco filler in two sheets of the pouch materials (if necessary, including the flavor filler between these sheets), and heat-sealing the first pouch material and second pouch material together.

EXAMPLES

Hereinafter, Examples of the present invention will be explained, but the present invention is not construed to be limited by those Examples.

Examples 1 to 4

[Preparation of Samples]

A tobacco filler was prepared by adding water to 0.5 g of a leaf tobacco powder so as to be 50% by weight of water content. The tobacco filler was wrapped in Spectra/Pro (Spectrum Laboratories, Inc.) Biotech Cellulose Ester Membranes CE dialysis tubes (made of cellulose ester, diameter 10 mm, length 2 cm) shown in FIG. 2, and then the both ends were heat sealed to prepare portion tobacco products. The CE dialysis tubes used in Examples 1 to 4 are hydrophilic and have cutoff molecular weights of 500, 3,500, 15,000 and 100,000, respectively.

Example 5

20 μl of a mixture of 4.0% by weight of egg yolk-derived lecithin (manufactured by Wako Pure Chemical Industries, Ltd.) and 96.0% by weight of oleic acid (manufactured by Wako Pure Chemical Industries, Ltd.) was applied to a Spectra/Por (Spectrum Laboratories, Inc.) Biotech polyvinylidene difluoride Membranes PVDF dialysis tube (made of polyvinylidene fluoride, diameter 12 mm, length 2 cm, cutoff molecular weight 500,000). A portion tobacco product was prepared in a similar manner to that of Examples 1 to 4, except that the tobacco filler was wrapped in the thus-treated PVDF dialysis tube and the both ends were fixed by a closer. The PVDF dialysis tube used in Example 5 is hydrophobic.

[Measurement of Elution Ratio]

The obtained portion tobacco product was put into a beaker filled with 200 ml of artificial saliva described in the document (Geis-Gerstorfer J, Weber H., "Effect of potassium thiocyanate on corrosion behavior of non-precious metal dental alloys" Dtsch Zahn. Arztl Z., 40, 87-91 (1985)), distilled water or a phosphate buffer solution, and stirred at 100 rpm for 20 minutes. The turbidity and chromaticity of the eluate containing the liquid eluted from the portion tobacco were measured by a transmitted light measuring method [a digital turbidity and chromaticity meter (KYORITSU CHEMICAL-CHECK Lab., Corp., WA-PT-4DG)]. Furthermore, nicotine contained in the tobacco filler in the portion tobacco was quantified before and after the test by the method described in the document (CORESTA RECOMMEND METHOD N62 "Determination of Nicotine in Tobacco and Tobacco Products by Chromatographic Analysis"), and a nicotine elution ratio was obtained by using the formula shown below.

Nicotine elution ratio=1−[(amount of nicotine contained in tobacco filler after test)/(amount of nicotine contained in tobacco filler before test)]

Comparative Example 1

A tobacco filler was prepared by adding water to 0.5 g of a leaf tobacco powder so as to be 50% by weight of water content. The tobacco filler was wrapped in a nonwoven fabric SDH27 (manufactured by BFF) shown in Table 2 to prepare a portion tobacco product. The procedures were similar to that of Examples 1 to 4, except that the eluate was diluted to 5-folds with distilled water in the measurement of the turbidity and chromaticity.

Comparative Example 2

A portion tobacco product was prepared in a similar manner to that of Examples 1 to 4, except that the tobacco filler was wrapped in a Spectra/Por (Spectrum Laboratories, Inc.) Biotech polyvinylidene difluoride Membranes PVDF dialysis tube (made of polyvinylidene fluoride, diameter 12 mm, length 2 cm, cutoff molecular weight 500,000) and the both ends were fixed by a closer.

The result of the above-mentioned measurement is shown in Table 2.

TABLE 2

Results of measurements of turbidity and chromaticity of eluates and nicotine elution ratio of eluates in case of using various membranes

| Experiment No. | Type of membrane: Material | Type of membrane: Cutoff molecular weight | Type of membrane: Property | Nicotine elution ratio | Eluate: Turbidity | Eluate: Chromaticity |
|---|---|---|---|---|---|---|
| Example 1 | Dialysis tube | 500 | Hydrophilic | 0.14 | 0.5 | 4.0 |
| Example 2 | (Cellulose ester) | 3,500 | | 0.32 | 1.0 | 10.5 |
| Example 3 | | 15,000 | | 0.48 | 1.5 | 20.0 |
| Example 4 | | 100,000 | | 0.72 | 10.0 | 48.0 |
| Example 5 | Dialysis tube (PVDF) | 500,000 | Hydrophobic | 0.52 | 2.0 | 22.5 |
| Comparative Example 1 | Nonwoven fabric SDH27 | Larger than 100,000 | Hydrophilic | 0.82 | 6.1 (5-fold dilution) | 46.5 (5-fold dilution) |
| Comparative Example 2 | Dialysis tube (PVDF) | 500,000 | Hydrophobic | 0.07 | 1.0 | 7.5 |

It is understood from the results of the turbidity and chromaticity of the eluates of Examples 1 to 4 and Comparative Example 1 that the turbidity and chromaticity are decreased by using a hydrophilic dialysis tube having an adjusted cutoff molecular weight. Specifically, the eluate in the case of a dialysis tube having a cutoff molecular weight of 15,000 has a turbidity of 1.5 degree and a chromaticity of 20.0 degree. The 5-fold diluted eluate in the case of a generally used nonwoven fabric has a turbidity of 6.1 degree and a chromaticity of 46.5 degree. It is estimated that the elution of the colorant component from the leaf tobacco material was suppressed effectively by using the dialysis tube having a cutoff molecular weight of 15,000 or less. Furthermore, it is understood that the nicotine elution ratio in the cases of dialysis tubes having a cutoff molecular weight of 500 or more is 0.14 or more, which is sufficient for eluting nicotine.

From the results of the turbidity and chromaticity of the eluate of Example 4, the hydrophilic dialysis tube having a cutoff molecular weight of 100,000 or more could not sufficiently suppress the elution of the colorant compound as compared to the dialysis tubes having cutoff molecular weights of 500, 3,500 and 15,000, respectively. However, when if chromaticity is 50 or less, it is considered that stain of gums or the like during or after use is not worried about.

It is understood from the result of the nicotine elution ratio in Comparative Example 2 that the hydrophobic dialysis tube could inhibit the elution of the colorant component but also inhibited the elution of nicotine that is a leaf tobacco component. On the other hand, it is understood from the result of Example 5 that it becomes possible to elute nicotine from such a hydrophobic dialysis tube by applying a mixture of lecithin that is one of phospholipids having an amphipathic property and a lipid to the hydrophobic dialysis tube. In Example 5, it is considered that nicotine elution is sufficient if the value of the nicotine elution ratio is 0.52, and that the elution of the colorant component could be inhibited if the values of the turbidity and chromaticity is 2.0 and 22.5, respectively.

Example 6

In the following example, the storage stability of the portion tobacco product of the present invention was confirmed.

A tobacco filler was prepared by adding 0.01 g of sodium carbonate to 0.5 g of a leaf tobacco powder to make a tobacco filler raw material and then adding water to it so that the water became 50% by weight with respect to the tobacco filler raw material. The obtained tobacco filler was wrapped with a Spectra/Pro (Spectrum Laboratories, Inc.) Biotech Cellulose Ester Membranes CE dialysis tube (made of cellulose ester, cutoff molecular weight 3,500, diameter 10 mm and length 2 cm), and the tube was further wrapped in a nonwoven fabric SDH27 (manufactured by BFF), thereby a sample portion tobacco was prepared. When the portion tobacco was stored in a refrigerator at 4° C. for 1 month, no spot was generated on the nonwoven fabric on the surface of the portion tobacco.

It was demonstrated by the above-mentioned Examples that the portion tobacco product of the present invention does not cause staining on a package during storage or staining on the gums and the like during use, without impairing the flavor of the component added to the tobacco filler or shreds.

[Other Effects (Efficiency, Safety, Durability, Cost and the Like)]

Dialysis tubes and the like are also used in artificial dialysis and the safety thereof is extremely high. Furthermore, since they are used in various filtrations and water purifications, they can be sufficiently provided for commercialization in terms of the supply and cost.

According to the present invention, a portion tobacco product can be obtained which does not cause staining on a pouch during storage or staining on the gums and the like during use, without impairing the flavor of the tobacco filler.

DESCRIPTION OF REFERENCE NUMBERS

10: Portion tobacco product
11: Tobacco filler
12: First pouch
13: Second pouch
14: Flavor filler
17: Heat seal part in longitudinal direction
18: Heat seal part in lateral direction

What is claimed is:

1. A portion tobacco product comprising a tobacco filler containing leaf tobacco or a leaf tobacco component, and a first pouch containing a wrapping material having a function of controlling the permeation of a compound contained in the tobacco filler, wherein the tobacco filler is included in the first pouch, and the wrapping material is a hydrophobic wrapper material having a cutoff molecular weight of 350 to 500,000 and contains an amphipathic substance disposed on the surface thereof which imparts an improved nicotine-permeation ability to the hydrophobic wrapper material while preventing the permeation of a colorant compound contained in the tobacco filler.

2. The portion tobacco product according to claim 1, wherein the first pouch is included in a second pouch containing a porous water-insoluble base material.

3. The portion tobacco product according to claim 1, wherein the portion tobacco product further comprises a second pouch containing a porous water-insoluble base material, the second pouch is placed inside of the first pouch, and the tobacco filler is directly included in the second pouch.

4. The portion tobacco product according to claim 2, wherein a flavor filler is included in a space between the first pouch and second pouch.

5. The portion tobacco product according to claim 1, wherein the first pouch comprises a heat seal material.

6. The portion tobacco product according to claim 2, wherein the second pouch comprises a heat seal material.

7. The portion tobacco product according to claim 1, wherein the tobacco filler comprises a flavoring agent.

8. The portion tobacco product according to claim 1, wherein the first pouch is composed of a dialysis tube.

9. The portion tobacco product of claim 1, wherein the amphipathic substance is selected from the group consisting of a phospholipid, a fat and oil, and a fatty acid.

10. The tobacco product of claim 1, wherein the hydrophobic wrapper material containing the amphipathic substance has a nicotine elution ratio which reaches 0.52.

* * * * *